United States Patent [19]

Degelmann

[11] Patent Number: 4,860,180

[45] Date of Patent: Aug. 22, 1989

[54] GRID SUSPENSION SYSTEM FOR FLUORESCENT TROFFERS

[75] Inventor: Paul G. Degelmann, Americus, Ga.

[73] Assignee: Cooper Industries, Inc., Houston, Tex.

[21] Appl. No.: 152,211

[22] Filed: Feb. 4, 1988

[51] Int. Cl.[4] ..... F21S 3/02

[52] U.S. Cl. ..... 362/150; 362/365; 362/404

[58] Field of Search ..... 362/145, 148, 150, 217, 362/364, 365, 404

[56] References Cited

U.S. PATENT DOCUMENTS

| | | | |
|---|---|---|---|
| 3,308,288 | 3/1967 | Ades | 362/150 |
| 3,512,313 | 5/1970 | Haze | 362/150 |
| 3,816,880 | 6/1974 | Jacobs | 362/150 |
| 4,086,480 | 4/1978 | Lahm | 362/148 |
| 4,646,212 | 2/1987 | Florence | 362/150 |
| 4,716,504 | 12/1987 | Pahl et al. | 362/150 |

*Primary Examiner*—Ira S. Lazarus
*Assistant Examiner*—Richard R. Cole
*Attorney, Agent, or Firm*—Allan R. Thiele; Eddie E. Scott

[57] ABSTRACT

A troffer for fluorescent lights, including a stabilizer system, the troffer for fluorescent lights in the present invention includes a stabilizer system to prevent the outward bending of fuel and suspension runners or stringers. The stabilizer system has a first vertical plate member attached to the fluorescent troffer, a slotted bridge member eminating perpendicularly from the first vertical plate member and a second vertical plate member extending perpendicularly from the slotted bridge member. The second vertical plate member includes a fastener which is threaded through the vertical plate member to contact the runner or stringer.

5 Claims, 3 Drawing Sheets

GRID SUSPENSION SYSTEM FOR FLUORESCENT TROFFERS

BACKGROUND OF THE INVENTION

The present device relates to mounting systems for suspended ceiling mounted lighting; more particularly the present invention relates to mounting systems for ceiling mounted troffers for fluorescent lighting.

Standard 20 inch×48 inch troffers for fluorescent lights are typically used with 60 inch×60 inch modular ceilings. Accordingly, the troffers do not exactly fit in the spaces formed in these 60 inch×60 inch modular ceilings. To accommodate this difference in size, two intermediate ceiling suspension runners or stringers are used to split each 60 inch×60 inch modular section into three smaller 20 inch×60 inch modules. When the troffers for fluorescent lights are installed in the center of the 20 inch×60 inch modules a 6 inch gap is left at either end the troffer. Lighting installation contractors generally use the two intermediate ceiling suspension runners or stringers to support the weight of the troffer. Because ceiling suspension runners or stringers are designed primarily for the support of tile and not for the support of troffers, there is a tendency in the ceiling suspension runners or stringers to rotate outwardly or banana peel because of the weight of the troffer.

The rotation or banana peeling of the ceiling suspension runners or stringers is unacceptable for several reasons. First, it presents an unsafe condition as the intermediate supporting surfaces are moving away from contact with the edges of the troffer thus reducing the surface support area. Second, distortion of portions of the ceiling presents an unsightly appearance.

Building codes demand safety of design. Architects and interior designers desire attractive ceiling treatments. Contractors have not been able to solve the problem by supporting troffers from the auxiliary suspension points to remove the weight of the troffer from the ceiling suspension runners or stringers or by locking intermediate suspension stringers together with cross T's at 48 inch intervals. Because of this failure to solve the stringer distortion by contractors, architects, designers and building code writers are looking to the manufactures of troffers to maintain the integrity of the ceiling system. Accordingly, there is a need for a troffer that does not cause intermediate ceiling suspension stringers or runners to bend outward when the troffer is placed thereon.

SUMMARY OF THE INVENTION

The troffer for fluorescent lights of the present invention includes a stabilizer system which prevents the outward bending of ceiling suspension runners or stringers. The stabilizer system includes a first vertical plate member which is attached to the fluorescent troffer. Perpendicular to the vertical plate member is a slotted bridge member which extends outwardly from the fluorescent troffer. The slot in the bridge member is wide enough to slip over the bulbous portion at the top of the stringer or runner yet so sized such that one edge of the slot contacts the bulbous portion of the stringer or runner. The third portion of the stabilizer system is a second vertical plate member which emanates particularly from the bridge member. Included at the bottom of the second vertical plate member is a threaded fastener. This threaded fastener threadably passes through the second vertical plate member and contacts the web portion of the runner or stringer. This contact between the web member and the threaded fastener urges the inner edge of the slot in the bridge member to contact the bulbous portion of the runner or stringer.

BRIEF DESCRIPTION OF THE DRAWINGS

A better understanding of the improved troffer with stabilizer system of the present invention may be had by reference to the figures wherein.

BRIEF DESCRIPTION OF THE EMBODIMENTS

Figure 1:
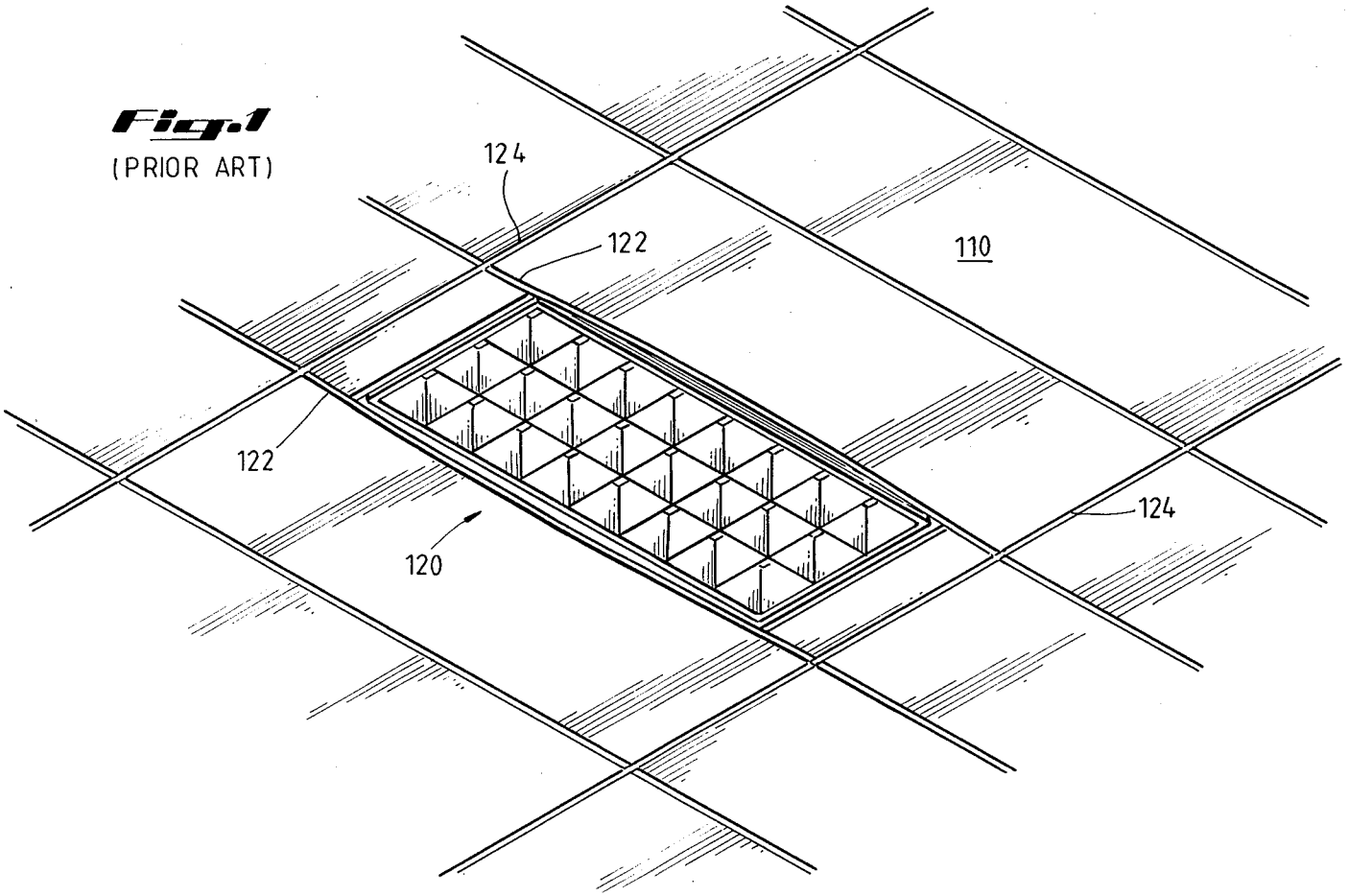
Fig.1 (PRIOR ART)
FIG. 1 is a perspective view of a prior art system of mounting troffers for fluorescent lights in a grid ceiling.
Figure 2:
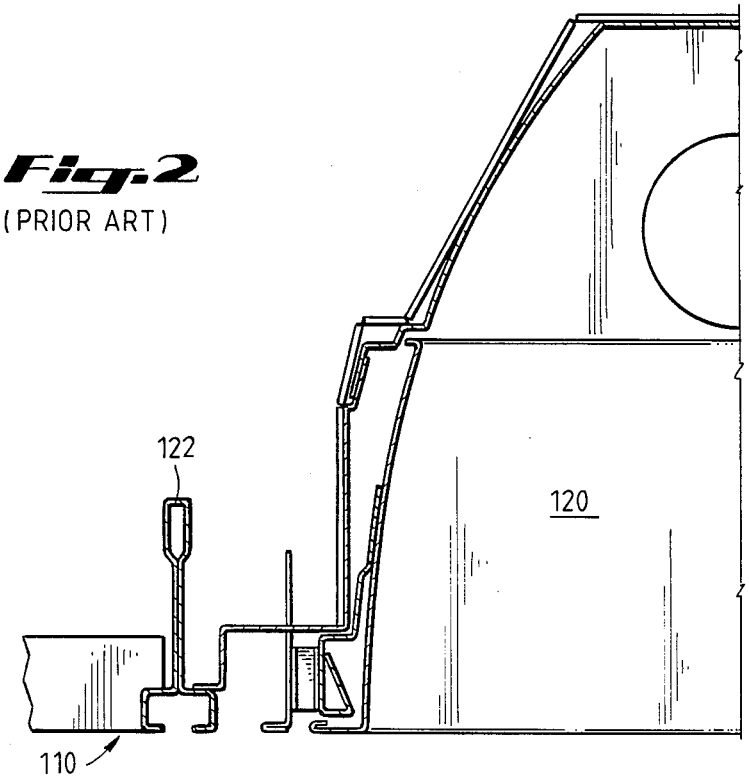
Fig. 2 (PRIOR ART)
FIG. 2 is an end view of a prior art system of mounting troffers for fluorescent lights in a grid ceiling.

A better understanding of the need for the improved troffer for fluorescent lights including a stabilization system 10 of the present invention may be had by reference to FIGS. 1 and 2 wherein the prior art system of mounting a troffer in a grid ceiling is shown. Therein it may be seen that the troffer 120 merely rests on ceiling suspension runners or stringer members 122 which are placed between the main grids 124 in a suspension ceiling 110. The weight of troffer 120 causes stringer members 122 to bow or banana peel away from troffer 120. This bowing or banana peeling causes an unsightly effect and possibly dangerous conditions.

Figure 3:
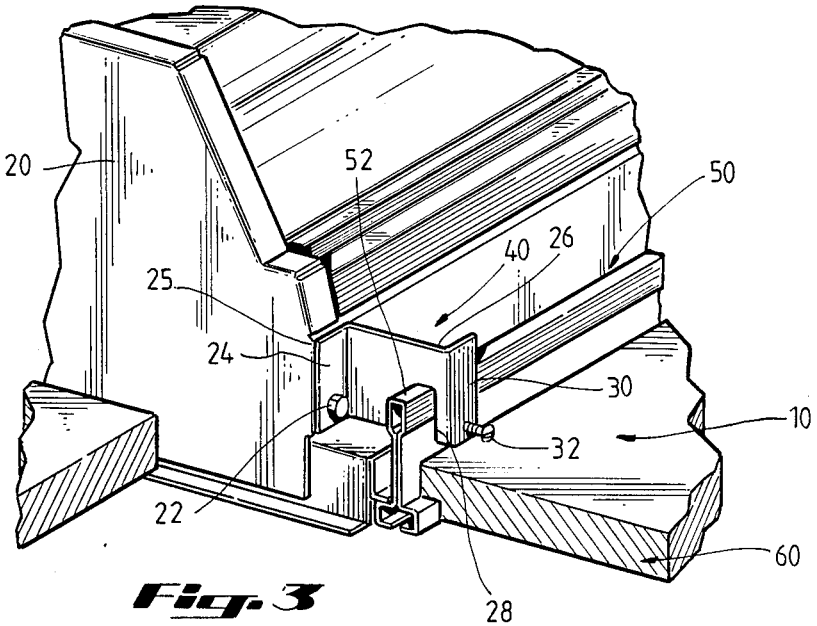
FIG. 3 is a perspective view of a troffer for fluoresent lights including the stabilization system of the present invention.
Figure 4:
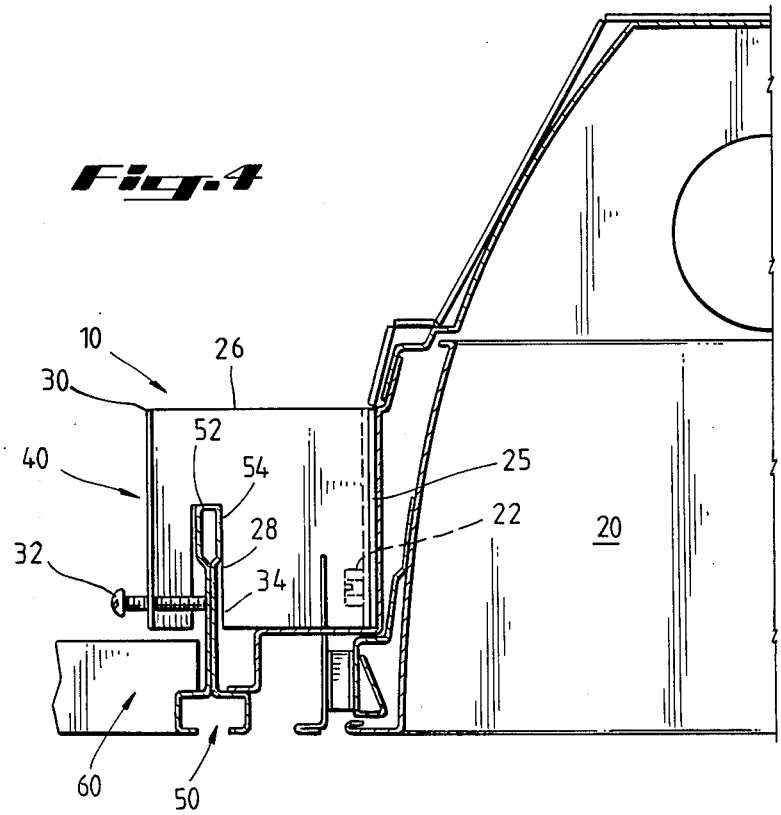
FIG. 4 is an end view of the troffer shown in FIG. 3.
Figure 5:
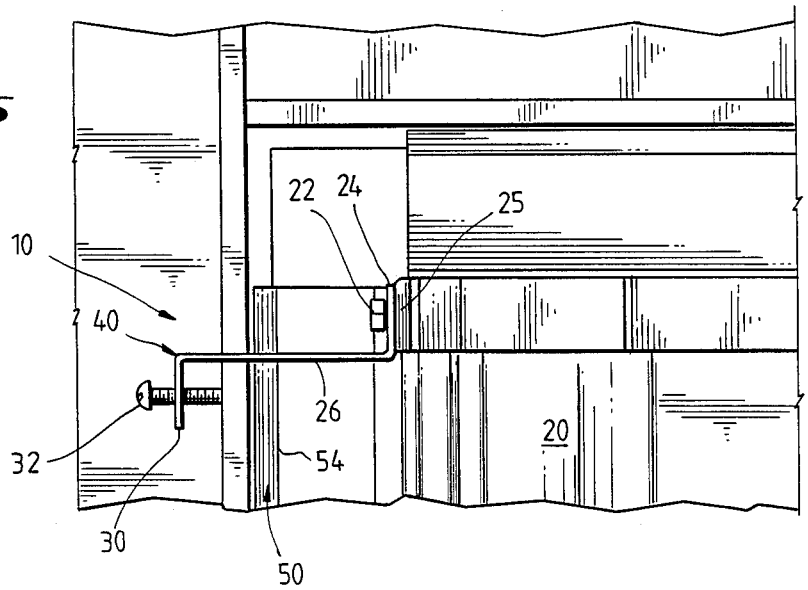
FIG. 5 is a top view thereof.

The troffer for fluorescent lights including a stabilization system 10 of the present invention is shown particularly with regard to FIGS. 3, 4 and 5. Therein it may be seen that the stabilization system 40 is mounted to the troffer 20 by a threaded fastener 22 which passes through a first vertical plate member 24 and into the side 25 of fluorescent troffer 20. Emanating from first vertical plate member 24 is bridge member 26 in which slot 28 is formed. Slot 28 is located such that it will pass over the bulbous portion 52 of stringer or runner 50. Stringer or runners 50 pass between the main grids of a grid type ceiling.

Emanating from the opposite end of bridge member 26 is a second vertical plate 30. At the bottom of vertical plate 30 is screw 32. Therein it may be seen, particularly with regard to FIG. 4, that tightening screw 32 results in the inside edge 34 of slot 28 coming in contact with the inside portion 54 of bulbous portion 52 of stringer 50. The stabilization system 40 of the present invention allows for fluorescent troffers 20 to be mounted in a grid type ceiling system 60 characterized by a number of intermediate stringers 50 without the bowing or banana peeling of the intermediate stringers 50 away from the sides of fluorescent troffer 10. If desired, vertical members 24 and 30 may be formed integrally with bridge member 26 from a single piece of metal.

The foregoing embodiments are intended to illustrate the present invention and not to limit it in spirit or scope.

I claim:

1. A troffer for fluorescent lights including a stabilizer system comprising:

a first substantially vertical plate member including a threaded fastener for mechanically attaching said first substantially vertical plate member to the troffer;

a bridge member formed substantially perpendicular to said first substantially vertical plate member, said bridge member including a slot constructed and arranged to fit over a runner or stringer used in a suspended ceiling and physically contact the side of said runner or stringer closest to said first substantially vertical plate member;

a second substantially vertical plate member including a threaded fastener for engaging the side of said runner or stringer opposite the side contacted by said slot.

2. The troffer as defined in claim 1 wherein said first substantially vertical plate member, said bridge member and said second substantially vertical plate member are formed integrally.

3. A lighting system for mounting in a suspended ceiling of runners or stringers comprising:

a fluorescent troffer;

a first substantially vertical plate member including a threaded fastener for mechanically attaching said first substantially vertical plate member to said fluorescent troffer;

a bridge member formed substantially perpendicular to said first substantially vertical plate member, said bridge member including a slot constructed and arranged to fit over the runners or stringers and physically contact the side of the runner or stringer closest to said first substantially vertical plate member;

a second substantially vertical plate member including a threaded fastener for contacting said runner or stringer.

4. The system as defined in claim 3 wherein said first substantially vertical plate member, said bridge member and said second substantially vertical plate member are formed integrally.

5. A method of stabilizing a fluorescent troffer in a suspended ceiling having runners or stringers, said method comprising the steps of:

affixing a first substantially vertical plate member to the side of a fluorescent troffer with a threaded fastener;

connecting said first substantially vertical plate member to a bridge member, said bridge member formed substantially perpendicular to said first substantially vertical plate member, said bridge member including a slot constructed and arranged to fit over the runners or stringers and physically contact the side of the runner or stringer closest to said first substantially vertical plate member;

connecting said bridge member to a second substantially vertical plate member, said second substantially vertical plate member further including a threaded fastener for engaging the opposite side of said runner or stringer.

* * * * *